US010435997B2

(12) United States Patent
Essam et al.

(10) Patent No.: US 10,435,997 B2
(45) Date of Patent: Oct. 8, 2019

(54) FLUID DELIVERY VESSEL INCLUDING A FLUID DELIVERY SYSTEM AND A REMOTELY OPERATED VEHICLE (ROV)

(71) Applicants: Sherif Essam, Aberdeen (GB); Amanda L. Parzniewski, Aberdeen (GB)

(72) Inventors: Sherif Essam, Aberdeen (GB); Amanda L. Parzniewski, Aberdeen (GB)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 0 days.

(21) Appl. No.: 15/798,919

(22) Filed: Oct. 31, 2017

(65) Prior Publication Data

US 2018/0216444 A1 Aug. 2, 2018

Related U.S. Application Data

(60) Provisional application No. 62/453,623, filed on Feb. 2, 2017.

(51) Int. Cl.
*E21B 41/04* (2006.01)
*B63B 27/25* (2006.01)
(Continued)

(52) U.S. Cl.
CPC ..... *E21B 41/04* (2013.01); *B63B 23/48* (2013.01); *B63B 27/25* (2013.01);
(Continued)

(58) Field of Classification Search
CPC ..... E21B 41/04; E21B 43/013; E21B 43/16; E21B 43/107; B63B 23/48; B63B 27/25;
(Continued)

(56) References Cited

U.S. PATENT DOCUMENTS 4,682,913 A * 7/1987 Shatto ..... E21B 33/0355 166/344
6,612,369 B1 * 9/2003 Rocha ..... E21B 19/002 166/339
(Continued)

FOREIGN PATENT DOCUMENTS

WO WO-2017023836 A1 * 2/2017 ..... E32B 17/015

OTHER PUBLICATIONS

Notification of Transmittal of the International Search Report and the Written Opinion of the International Searching Authority, or the Declaration; PCT/US2018/016412; dated May 14, 2018; 16 pages.

*Primary Examiner* — James G Sayre
(74) *Attorney, Agent, or Firm* — Cantor Colburn LLP

(57) ABSTRACT

A fluid delivery vessel for containing and introducing a fluid into a wellbore includes a hull including a deck and a fluid storage area, and a fluid delivery system including a conduit having a first end fluidically connected to the fluid storage area and a second end. The conduit selectively delivers a fluid from the fluid storage area into the wellbore. A remotely operated vehicle (ROV) system support platform is mounted to the deck, and a ROV deployment system supported by the ROV system support platform. The ROV deployment system is operable to selectively deploy and retrieve an ROV.

12 Claims, 4 Drawing Sheets

(51) Int. Cl.

| | |
|---|---|
| ***B63G 8/00*** | (2006.01) |
| ***E21B 43/013*** | (2006.01) |
| ***B63B 23/48*** | (2006.01) |
| ***E21B 43/01*** | (2006.01) |
| ***B63B 35/44*** | (2006.01) |

(52) U.S. Cl.
CPC ..... *B63B 35/4413* (2013.01); *B63G 8/001* (2013.01); *E21B 43/01* (2013.01); *E21B 43/013* (2013.01); *B63G 2008/005* (2013.01)

(58) Field of Classification Search
CPC ..... B63B 2027/165; B63G 8/001; B63G 2008/005; B63G 2027/165
USPC ..... 166/367
See application file for complete search history.

(56) References Cited

U.S. PATENT DOCUMENTS

| | | | | |
|---|---|---|---|---|
| 6,763,889 | B2 * | 7/2004 | Rytlewski | B63G 8/001 166/338 |
| 7,509,919 | B2 * | 3/2009 | Sebellin | B63B 35/00 114/258 |
| 9,359,046 | B2 * | 6/2016 | Rosche | B63B 21/66 |
| 9,540,076 | B1 * | 1/2017 | Trail | B63B 27/08 |
| 9,815,528 | B2 * | 11/2017 | Baugh | B63B 27/08 |
| 2008/0247827 | A1 * | 10/2008 | Altman | B63B 9/065 405/197 |
| 2009/0255680 | A1 * | 10/2009 | Maxwell | E21B 33/10 166/339 |
| 2010/0047040 | A1 * | 2/2010 | Burgess | B63B 27/02 414/137.7 |
| 2012/0210926 | A1 * | 8/2012 | Storm, Jr. | B63C 11/26 114/337 |
| 2012/0315096 | A1 * | 12/2012 | Byers | B63C 7/02 405/195.1 |
| 2013/0327534 | A1 | 12/2013 | Christie et al. | |
| 2014/0086719 | A1 * | 3/2014 | Gerard | B63C 3/06 414/800 |
| 2014/0332269 | A1 * | 11/2014 | Smith | E21B 21/02 175/5 |
| 2015/0307174 | A1 | 10/2015 | Zediker et al. | |
| 2016/0297690 | A1 * | 10/2016 | McLelland | C02F 1/40 |
| 2017/0260835 | A1 * | 9/2017 | Crawford | E21B 43/013 |

* cited by examiner

FLUID DELIVERY VESSEL INCLUDING A FLUID DELIVERY SYSTEM AND A REMOTELY OPERATED VEHICLE (ROV)

CROSS REFERENCE TO RELATED APPLICATIONS

This application claims priority to U.S. Provisional Patent Application Ser. No. 62/453,623, filed Feb. 2, 2017, which is incorporated by reference herein in its entirety.

BACKGROUND

Downhole operations often involve the pumping of fluids into a wellbore. For example, a fracturing operation will often involve pumping a stimulation fluid into a wellbore to enhance production. For a subsea well, a stimulation operations involving pumping fluids is a complex process. A stimulation vessel carrying stimulation fluid is positioned over a subsea wellhead. A remotely operated vehicle (ROV) vessel is also positioned over the subsea wellhead. Additional support vessels may also be needed to execute these operations.\

A conduit is passed from the stimulation vessel, supply vessel or other diving support vessel toward the subsea wellhead. An ROV is deployed from the ROV vessel and guided toward the conduit. An operator controls the ROV to guide the conduit towards, and connect the conduit with the subsea wellhead. Coordinating efforts from multiple vessels to stimulate a wellbore, as executed today, is a complex process. It is important to maintain separation between vessels, conduits connecting to the ROV, and the conduit being connected to the well head. In addition to the complexity of operations, health, safety and environment (HSE) implications, the cost of operations, maintenance, and the logistics of employing multiple vessels is high.

SUMMARY

A fluid delivery vessel for containing and introducing a fluid into a wellbore includes a hull including a deck and a fluid storage area, and a fluid delivery system including a conduit having a first end fluidically connected to the fluid storage area and a second end. The conduit selectively delivers a fluid from the fluid storage area into the wellbore. A remotely operated vehicle (ROV) system support platform is mounted to the deck, and a ROV deployment system supported by the ROV system support platform. The ROV deployment system is operable to selectively deploy and retrieve an ROV.

A method of treating a wellbore from a fluid delivery vessel includes deploying a fluid delivery conduit from the fluid delivery vessel towards the wellbore, deploying a remotely operated vehicle (ROV) from the fluid delivery vessel, connecting the ROV to the fluid delivery conduit, transporting by the ROV the fluid delivery conduit to a well head of the wellbore, and connecting the fluid delivery conduit to the well head with the ROV.

BRIEF DESCRIPTION OF THE DRAWINGS

Referring now to the drawings wherein like elements are numbered alike in the several Figures.

DETAILED DESCRIPTION

Figure 1:
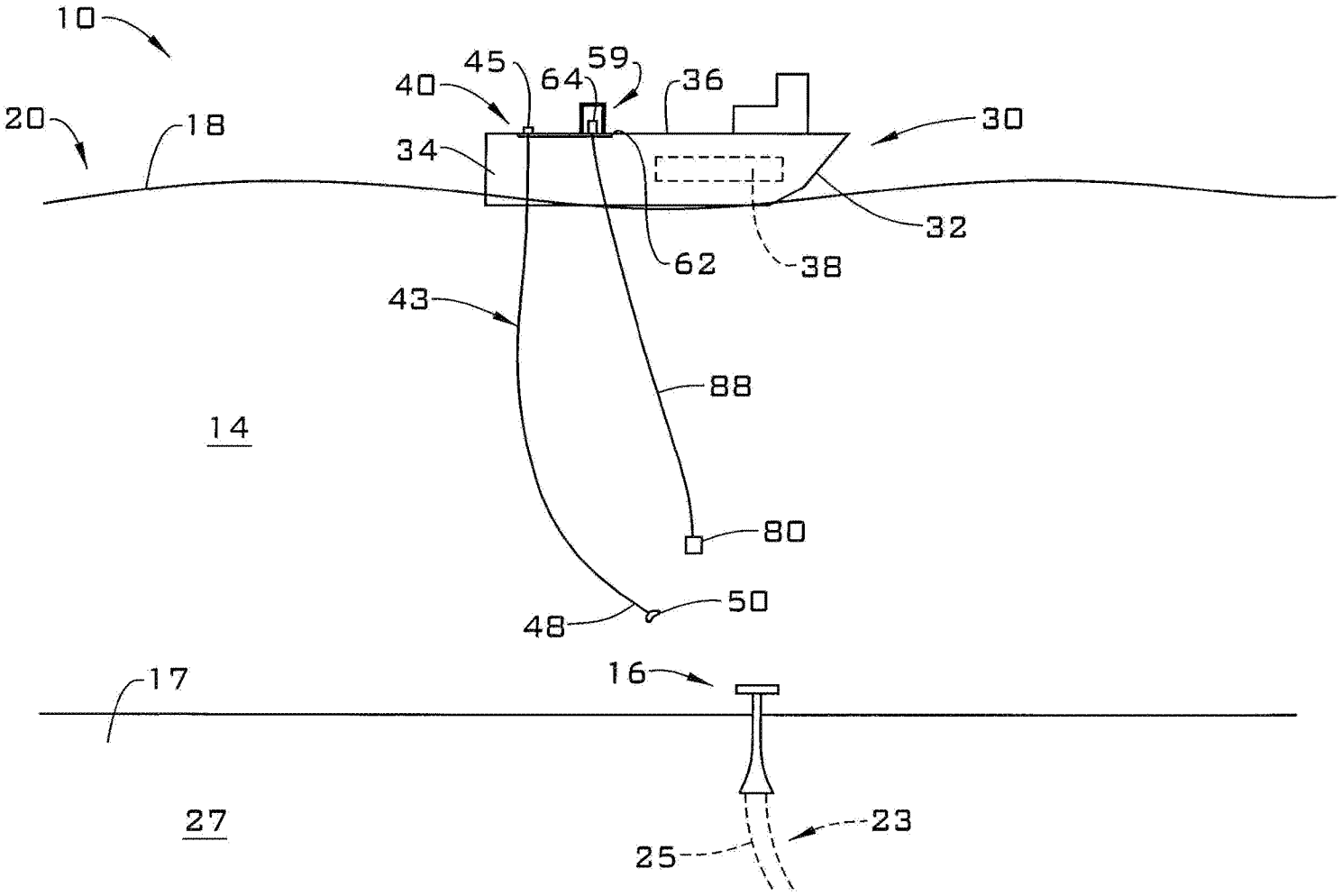
FIG. 1 depicts an integrated subsea well production enhancement system, in accordance with an aspect of an exemplary embodiment.

An integrated subsea well production enhancement system, in accordance with an exemplary embodiment, is illustrated generally at 10 in FIG. 1. Integrated subsea well production enhancement system 10 includes a subsea element 14 that may take the form of a subsea wellhead 16 that extends from a sea floor 17 towards a surface 18 of a body of water 20. Integrated subsea well production enhancement system 10 also includes a downhole portion 23 that may include a wellbore 25 having a plurality of tubulars (not separately labeled) that extends into a formation 27 from wellhead 16.

In accordance with an aspect of an exemplary embodiment, an integrated subsea well production enhancement system 10 also includes a surface portion 30 that may take the form of a fluid delivery ship or vessel 32 stationed on surface 18 above wellhead 16. Fluid delivery vessel 32 includes a vessel body or hull 34 that supports a deck 36 and a fluid storage area 38. Deck 36 may exist on multiple levels and supports a fluid delivery system 40. A conduit 43 extends from fluid delivery vessel 32 toward wellhead 16. Conduit 43 includes a first end 45 that is fluidically connected to fluid storage area 38 and a second end 48 that includes a connector 50. Connector 50 may be selectively connected to wellhead 16. Fluid delivery vessel 32 may selectively deliver a treatment or stimulation fluid through conduit 43 into formation 27 as will be detailed below.

Figure 2:
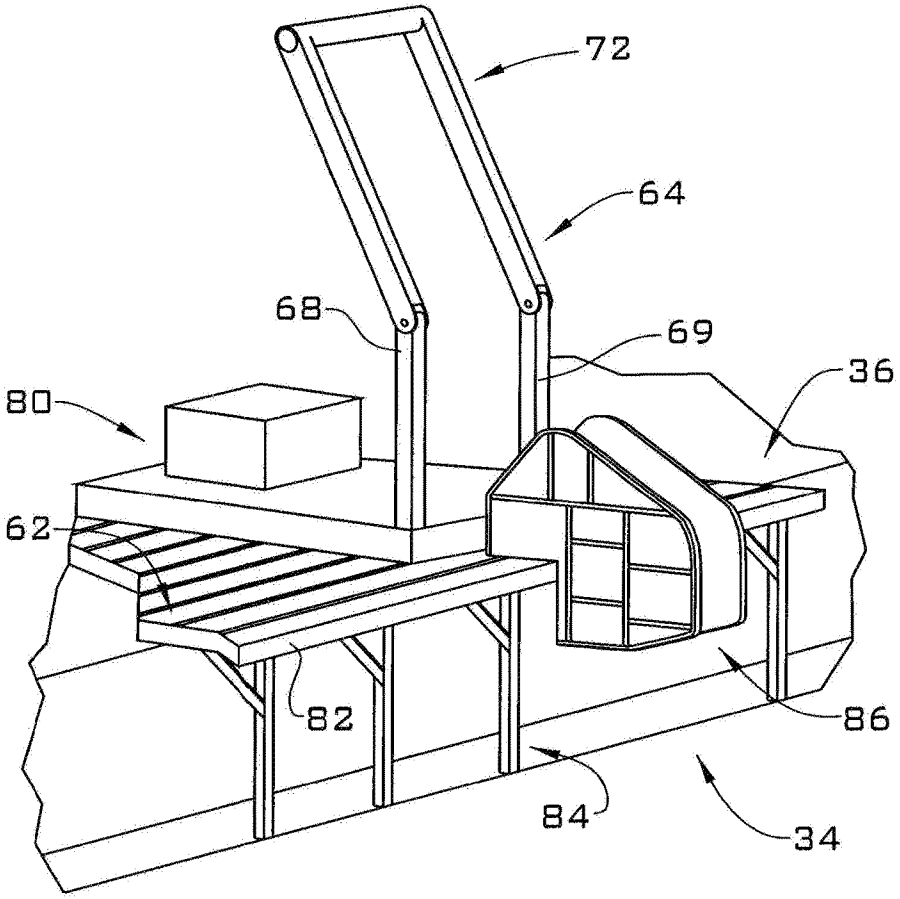
FIG. 2 depicts a remotely operated vehicle (ROV) system mounted to a fluid delivery vessel, in accordance with an aspect of an exemplary embodiment.
Figure 3:
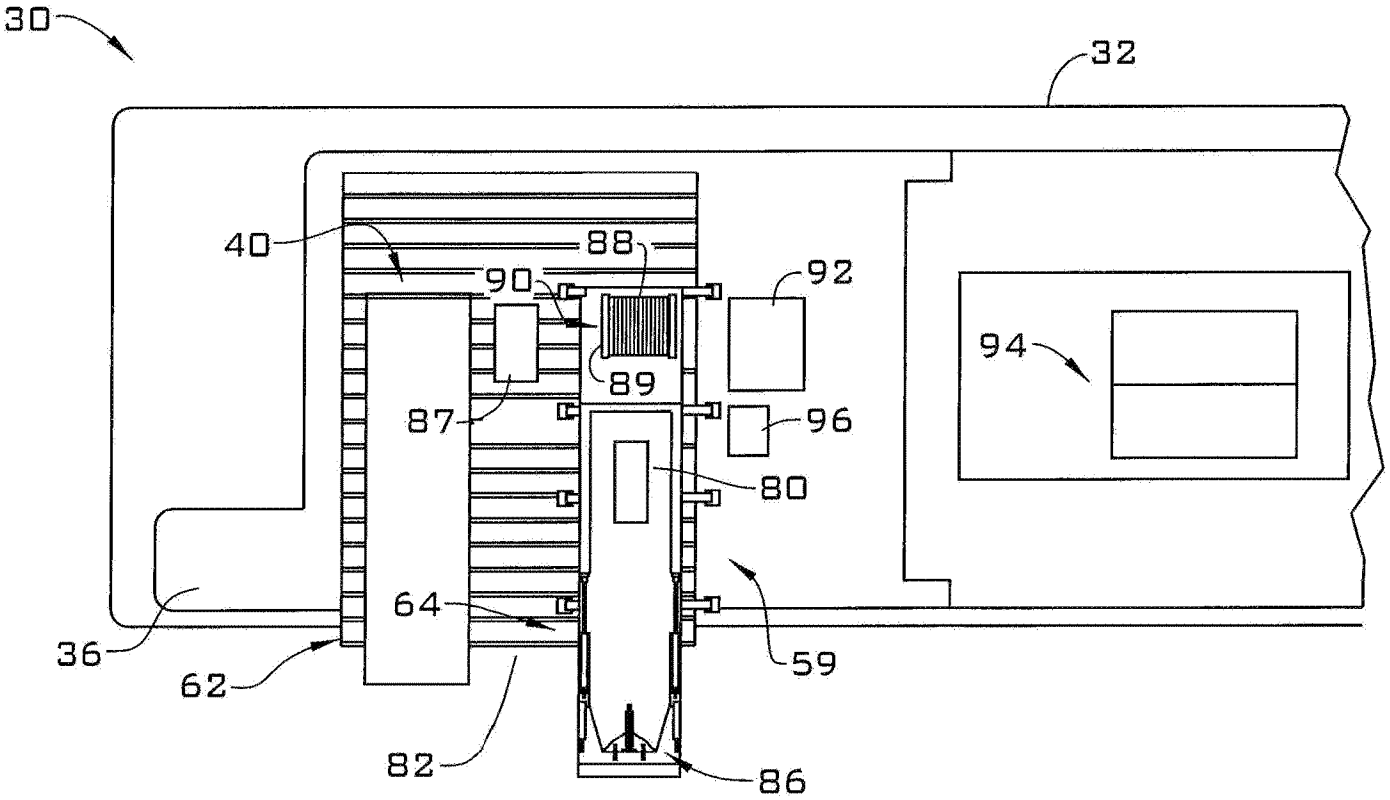
FIG. 3 depicts a top view of a portion of a deck of the fluid delivery vessel including the ROV system, in accordance with an aspect of an exemplary embodiment.

In accordance with an aspect of an exemplary embodiment, fluid delivery vessel 32 also supports a remotely operated vehicle (ROV) system 59 which, as will be detailed more fully below, is operated to connected second end 48 of conduit 43 to wellhead 16. As shown in FIGS. 2 and 3, fluid delivery vessel 32 includes a ROV system support platform 62 coupled to deck 36. ROV system support platform 62 supports an ROV deployment system 64 having a first support member 68, a second support member 69, and a lifting member 72 pivotally connected to first and second support members 68 and 69. Lifting member 72 is employed to selectively transition a ROV 80 from a stowed configuration to a deployed configuration.

In further accordance with an exemplary embodiment, ROV system support platform 62 includes a cantilevered end 82 extends outwardly of deck 36. Cantilevered end 82 is coupled to vessel hull 34 through one or more support members 84. Support members 84 distribute loads supported on ROV system support platform 62 through vessel hull 34 along a desired path to eliminate tipping of vessel 32 that may be associated with an unbalanced load, particularly, an unbalanced load that may exist after injecting fluid into formation 27. Cantilevered end 82 also supports a ROV guidance member 86 that facilitates deployment of ROV 80. ROV guidance member 86 may help control off boarding and/or on boarding of ROV 80 as well as ROV cable 88.

ROV system support platform 62 may also support a ROV cable 88 that is coupled to ROV 80. ROV cable 88 may be wound around a ROV cable reel 89 that is operatively associated with or which forms part of winch 90. Winch 90 is selectively operated to lower ROV 80 towards sea floor 17 and/or retrieve ROV 80 to fluid delivery vessel 32. ROV cable 88 may also include one or more control cables (not separately labeled) that provide a communications pathway from fluid delivery vessel 32 to ROV 80. Fluid delivery vessel 32 may also include a power unit 87 coupled to winch 90. Power unit 87 may provide motive power to shift ROV 80 utilizing winch 90. Fluid delivery vessel 32 may also include additional support equipment such as rigging containers 92, workshop containers 94, and deck carts 96.

Figure 4:
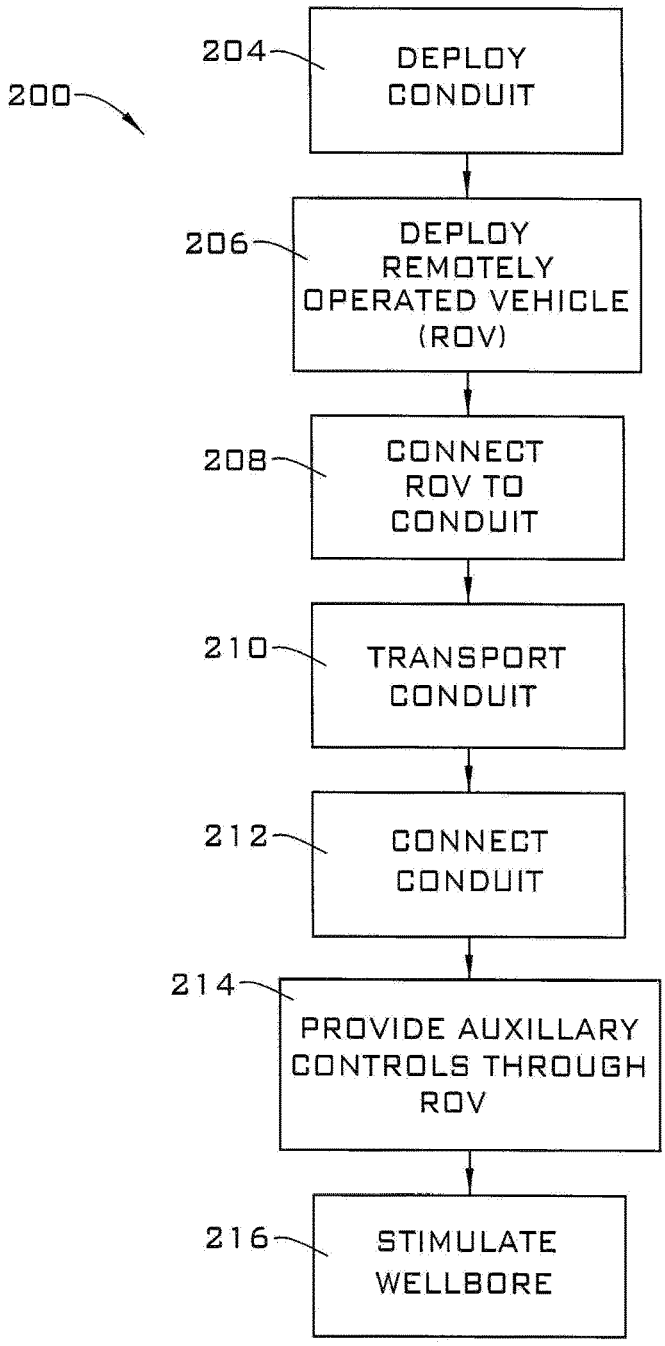
FIG. 4 depicts a flow chart illustrating a method of treating a wellbore, in accordance with an aspect of an exemplary embodiment.

Reference will now follow to FIG. 4 in describing a method 200 of treating wellbore 25. Conduit 43 is deployed from fluid delivery vessel 32 in block 204. In block 206, ROV 80 is deployed from ROV system support platform 62. Lifting member 72 raises and swings ROV 80 over cantilevered end 82. Winch 90 is activated to lower ROV 80 from fluid delivery vessel 32. ROV 80 and subsequently ROV cable 88 may be guided by ROV guidance member 86. ROV 80 is guided toward second end 48 of conduit 43. Once in position, ROV 80 may connect with second end 48 in block 208. ROV 80 is then guided, with conduit 43, toward wellhead 16 in block 210. ROV 80 may then be manipulated to couple connector 50 to wellhead 16 in block 212. ROV 80 may also be manipulated to provide auxiliary controls at subsea wellhead 16 as indicated in block 214.

Once coupled, pumps (not shown) may be activated to deliver fluid from fluid storage area 38 into formation 27 to perform, for example, a stimulation operation in block 216. It is to be understood that fluid delivery vessel may be employed to conduct a wide array of operations. Fluid delivery system 40 is not limited to performing stimulation operations.

It is to be understood that the exemplary embodiments describe a fluid delivery vessel that not only includes fluid delivery systems but also supports a ROV system for coupling a fluid delivery conduit to a subsea well head. The design of the ROV system support platform ensures that the fluid delivery vessel remains stable even after off-loading all stored fluid. By incorporating both fluid delivery and ROV operation into a single vessel, the need to coordinate multiple vessels at a well bore location is eliminated. Further, incorporated both systems into a single vessel reduces health, safety and environmental (HSE) implications, operational costs and streamlines treatment, stimulation, and other fluid operations at a subsea wellbore.

Embodiment 1

A fluid delivery vessel for containing and introducing a fluid into a wellbore comprising: a hull including a deck and a fluid storage area; a fluid delivery system including a conduit having a first end fluidically connected to the fluid storage area and a second end, the conduit selectively delivering a fluid from the fluid storage area into the wellbore; a remotely operated vehicle (ROV) system support platform mounted to the deck; and a ROV deployment system supported by the ROV system support platform, the ROV deployment system being operable to selectively deploy and retrieve an ROV.

Embodiment 2

The fluid delivery vessel according to any prior embodiment, wherein the ROV system support platform extends outwardly of the deck.

Embodiment 3

The fluid delivery vessel according to any prior embodiment, wherein the ROV deployment system includes a first support member, a second support member, and a lifting member shiftably connected between the first support member and the second support member.

Embodiment 4

The fluid delivery vessel according to any prior embodiment, further comprising: an ROV selectively supported on the ROV system support platform.

Embodiment 5

The fluid delivery vessel according to any prior embodiment, further comprising: an ROV cable supported by a ROV cable reel operatively coupled to the fluid delivery vessel and the ROV. The fluid delivery vessel according to any prior embodiment, further comprising a winch mounted to the ROV system support platform, the winch being operatively connected to the ROV cable reel.

Embodiment 6

The fluid delivery vessel according to any prior embodiment, further comprising a power unit mounted to the ROV system support platform and operatively connected to the winch.

Embodiment 7

The fluid delivery vessel according to any prior embodiment, wherein the ROV system support platform includes a cantilevered end that extends outwardly from the deck.

Embodiment 8

The fluid delivery vessel according to any prior embodiment, further comprising a plurality of support members that extend from the cantilevered end to the hull.

Embodiment 9

The fluid delivery vessel according to any prior embodiment, further comprising an ROV guidance member mounted to the cantilevered end of the ROV system support platform.

Embodiment 10

A method of treating a wellbore from a fluid delivery vessel comprising deploying a fluid delivery conduit from the fluid delivery vessel towards the wellbore, deploying a remotely operated vehicle (ROV) from the fluid delivery vessel, connecting the ROV to the fluid delivery conduit, transporting by the ROV the fluid delivery conduit to a well head of the wellbore, and connecting the fluid delivery conduit to the well head with the ROV.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, water flooding, cementing, etc.

While one or more embodiments have been shown and described, modifications and substitutions may be made thereto without departing from the spirit and scope of the invention. Accordingly, it is to be understood that the present invention has been described by way of illustrations and not limitation.

What is claimed is:

1. A floating vessel for performing fracturing operations containing and introducing a stimulation fluid into a wellbore comprising:

a hull including a deck defining, at least in part, the floating vessel and a fluid storage area housing a stimulation fluid provided in the floating vessel;

a stimulation fluid delivery system for performing the fracturing operation, the stimulation fluid delivery system including a conduit having a first end fluidically connected to the fluid storage area and a second end, the conduit selectively delivering the stimulation fluid from the fluid storage area into the wellbore;

a remotely operated vehicle (ROV) system support platform mounted to the deck; and a ROV deployment system supported by the ROV system support platform, the ROV deployment system being operable to selectively deploy and retrieve an ROV that is selectively operatively connectable to the conduit.

2. The fluid delivery vessel according to claim 1, wherein the ROV system support platform extends outwardly of the deck.

3. The fluid delivery vessel according to claim 1, wherein the ROV deployment system includes a first support member, a second support member, and a lifting member pivotally connected between the first support member and the second support member.

4. The fluid delivery vessel according to claim 1, further comprising: an ROV selectively supported on the ROV system support platform.

5. The fluid delivery vessel according to claim 4, further comprising: an ROV cable supported by a ROV cable reel operatively coupled to the fluid delivery vessel and the ROV.

6. The fluid delivery vessel according to claim 5, further comprising: a power unit mounted to the ROV system support platform and operatively connected to the winch.

7. The fluid delivery vessel according to claim 5, further comprising: a winch mounted to the ROV system support platform, the winch being operatively connected to the ROV cable reel.

8. The fluid delivery vessel according to claim 1, wherein the ROV system support platform includes a cantilevered end that extends outwardly from the deck.

9. The fluid delivery vessel according to claim 8, further comprising: a plurality of support members that extend from the cantilevered end to the hull.

10. The fluid delivery vessel according to claim 8, further comprising: an ROV guidance member mounted to the cantilevered end of the ROV system support platform.

11. A method of performing a fracturing operation at a wellbore in a subsea formation from a floating fluid delivery vessel comprising:

deploying a fluid delivery conduit from the floating fluid delivery vessel towards the wellbore;

deploying a remotely operated vehicle (ROV) from the fluid delivery vessel;

connecting the ROV to the fluid delivery conduit;

transporting by the ROV the fluid delivery conduit to a well head of the wellbore;

connecting the fluid delivery conduit to the well head with the ROV; and introducing a stimulation fluid from the fluid delivery vessel into the wellbore to initiate a fracture in a subsea formation.

12. The method of claim 11, wherein introducing the fluid includes delivering a stimulation fluid into a formation defining the wellbore.

* * * * *